US005423620A

United States Patent [19]

Tokairin

[11] Patent Number: 5,423,620

[45] Date of Patent: Jun. 13, 1995

[54] CONVEYANCE APPARATUS FOR A CONTINUOUS FORM PRINTED BY A PRINTING MACHINE

[75] Inventor: Motohiro Tokairin, Kawasaki, Japan

[73] Assignee: Fujitsu Limited, Kawasaki, Japan

[21] Appl. No.: 123,401

[22] Filed: Sep. 17, 1993

[30] Foreign Application Priority Data

Mar. 8, 1993 [JP] Japan ..... 5-046682

[51] Int. Cl.[6] ..... B41J 11/42

[52] U.S. Cl. ..... 400/582; 400/583.4; 400/593; 400/618; 400/708

[58] Field of Search ..... 400/593, 616, 618, 621, 400/621.1, 706, 707.1, 708, 583.4, 582

[56] References Cited

U.S. PATENT DOCUMENTS

| | | | |
|---|---|---|---|
| 4,630,814 | 12/1986 | Kawakubo et al. | 400/639.1 |
| 4,895,466 | 1/1990 | Hartman et al. | 400/621 |
| 4,941,377 | 7/1990 | Ishihara et al. | 400/621 |
| 4,981,378 | 1/1991 | Krämer | 400/621 |

FOREIGN PATENT DOCUMENTS

| | | | |
|---|---|---|---|
| 49-5229 | 1/1974 | Japan . | |
| 53-14018 | 2/1978 | Japan . | |
| 56-21173 | 2/1981 | Japan . | |
| 451182 | 2/1982 | Japan . | |
| 57-158869 | 9/1982 | Japan . | |
| 0218315 | 4/1987 | Japan . | |
| 0227672 | 10/1987 | Japan . | |
| 63-123751 | 5/1988 | Japan . | |
| 1011863 | 1/1989 | Japan | 400/582 |
| 288271 | 3/1990 | Japan . | |

*Primary Examiner*—Edgar S. Burr
*Assistant Examiner*—John S. Hilten

[57] ABSTRACT

Conveyance apparatus for a continuous form having sprocket holes on both sides thereof provided in a high-speed printing system, comprised of a printing machine and an after-treatment machine, including: a constant-speed conveyance roller for feeding the continuous form to the printer; a pair of ejection rollers located downstream of the constant-speed conveyance roller for conveying and ejecting the continuous form, under tension, by rotating a little faster than the constant-speed conveyance roller; a pair of drawing rollers provided at the entrance to the after-treatment machine for pulling the continuous form therein injected by the printing machine; an end sensor for outputting an end signal when a disengagement between the last sprocket hole and the constant-speed conveyance roller is detected; and a controller. The controller in the first aspect changes the peripheral speed of the ejection rollers to lower than that of the constant-speed conveyance roller when the end signal is received from the end sensor. The controller in the second aspect stops supplying the power to a driver of the ejection rollers, a predetermined time after the end signal is received from the end sensor. The controller in the third aspect changes the peripheral speed of the drawing rollers to faster than that of the ejection rollers to provide tension to the continuous form when the end signal is received from the end sensor. As a result, the continuous form is treated smoothly in the after-treatment machine even at the end thereof.

8 Claims, 10 Drawing Sheets

PRINTING MACHINE
20
23
END SENSOR
23A
23B
25
21
27
22C
CONTROL CIRCUIT
22D
SSR
22E
22M
MOTOR
40
AFTER-TREATMENT MACHINE
30
31C
CONTROL CIRCUIT
31D
PLL
31M
M
31G
31E
CLOCK

CONVEYANCE APPARATUS FOR A CONTINUOUS FORM PRINTED BY A PRINTING MACHINE

BACKGROUND OF THE INVENTION

1. Field of the invention

The present invention relates to a conveyance apparatus for a continuous form printed by a printing machine, particularly the present invention relates to a conveyance apparatus for a continuous form, having sprocket holes on both edges thereof, carried at a constant speed by a rotating tractor such as a sprocket, a pin roller (a roller having pins planted with equal interval on the edge thereof), or a pin belt, to feed the continuous form printed by a printing machine to an after-treatment machine by using carrier rollers.

2. Description of the Related Art

In recent years, high-speed printing machines for printing data output, from a network of small computers or from a single large computer, on a continuous form is utilized for making individual forms or individual business reports.

High-speed printing machines for continuous forms and a conveyance of the continuous form are disclosed in japanese patent application numbers (KOKAI) S49-5229, S57-158869, and H4-51182.

An example of the structure of a conventional high-speed printing system PS is shown in FIG. 1. The conventional printing system PS includes a high-speed printing machine PM to print on the continuous form 9, and an after-treatment machine AM to conduct an after-treatment on the printed continuous form 9 such as cutting thereof or separation thereof in accordance with the type of printing thereon.

The printing machine PM in this example uses the technology of an electrophotography, so that it Lncludes a continuous form stock 1, a printing unit 2 having a photoreceptor drum 3, a pin roller 4, a fixing unit 5, conveyance rollers 6, a pair of ejection rollers 7, an end sensor 8, and a control unit 10. The after-treatment machine AM includes a pair of drawing rollers 11, a pair of cutters 12 for cutting the continuous form 9, a stacker 13, a movable carriage 14, and two pairs of conveyance rollers 15.

In the printing machine PM, the rotating photoreceptor drum 3 is electrically charged and a latent image is formed on the photoreceptor drum 3 by a laser beam transmitted from the optical unit (not shown). This latent image is developed by toner and a toner image is formed on the photoreceptor drum 3. Then the toner image on the photoreceptor drum 3 is transferred onto the continuous form 9 fed to the rotating photoreceptor drum 3 at the same speed as the rotational speed thereof, and high-speed printing is realized.

FIG. 2 shows the continuous form 9 to be printed by the high-speed printing machine PM in FIG. 1. As shown in FIG. 2, there are provided series of holes hereinafter sprocket holes) 91 on both edges of the continuous form 9. The distance between the sprocket holes 91 is the same as the distance between the pins 41 on the pin roller 4 in FIG. 1. The continuous form 9 is conveyed by the pin roller 4 by its sprocket holes 91 engaged with pins 41. Since the rotational speed of the pin roller 4 is the same as that of the photoreceptor drum 3, the conveyance speed of the continuous form 9 is exactly the same as the peripheral speed of the photoreceptor drum 3.

As shown in FIG. 1, there is provided a fixing unit 5 for fixing the toner on the continuous form 9 at the downstream side of the printing unit 2, a pair of ejection rollers 7 at the downstream side of the fixing unit 5, and conveyance rollers 6 between the printing unit 2 and the ejection rollers 7. The ejection rollers 7 pinch the continuous form 9 and rotate a little faster than the rotational speed of the pin roller 4 to input tension to the continuous form 9 between the printing unit 2 and the ejection rollers 7 where the fixing unit 5 is located.

In other words, the ejection rollers 7 have a faster peripheral speed than the conveyance speed of the continuous form 9 conveyed by the pin roller 4 when the ejection rollers are not ejecting paper. However, the rotational speed of the ejection rollers 7 is reduced when the continuous form 9 is engaged with the pin roller 4, since the peripheral speed of the pin roller 4 is lower than the peripheral speed of the ejection rollers 7. The torque produced by the ejection rollers 7 is changed to tension on the continuous form 9 between the printing unit 2 and the ejection rollers 7. The ejection rollers 7 pinching the continuous form 9 slip on the surface thereof.

The continuous form 9 is pulled into the after-treatment machine AM by the drawing rollers 11 and conveyed by the conveyance rollers 15. The continuous form 9 is folded and is piled in the stacker 13. The pair of cutters 12 are located between the two pairs of conveyance rollers 15 facing each other and cut the continuous form 9 at the change of the substance of the print. When the continuous form 9 is cut, it will become a sheaf of papers and will be stacked on the movable carriage 14 separatably as shown in FIG. 1.

The cutters 12 are activated, synchronously with the printing speed on the continuous form 9 at the photoreceptor drum 3, to cut the continuous form 9. The drawing rollers pull in the continuous form 9 at the conveyance speed thereof by the pin roller 4. That is, the continuous form 9 is after-treated in the after-treatment machine AM at the printing speed of the printing unit 2 in the printing machine PM.

However, above-described printing system PS has a frequently occurring problem at the end of the continuous form 9. Precisely, during normal printing, the continuous form 9 is pulled by the pin roller 4 rotating at the constant speed and the reduced peripheral speed of the ejection rollers 7 is to the peripheral speed of the pin roller 4, but the peripheral speed of the ejection rollers is increased when the continuous form 9 is disengaged from the pin roller 4. Accordingly, the speed of the continuous form 9 through the ejection rollers 7 is suddenly increased, though the conveyance speed of the continuous form 9 in the after-treatment machine AM is not changed from the conveyance speed of the pin roller 4. As a result, the continuous form 9 is jammed into the drawing rollers 11, and various problems may occur, such as the continuous form 9 is pulled by the drawing rollers 11 in a twisted or a folded condition, the continuous form 9 jams in the after-treatment machine AM, or the continuous form 9 is irregularly cut by the cutters 12.

SUMMARY OF THE INVENTION

The object of the present invention is to provide a conveyance apparatus for a continuous form printed by a printing machine, by which a normal conveyance condition of the continuous form is continuously maintained after the form disengages from the last sprocket hole at the end of the continuous form, whereby a stable after-treatment of the continuous form by the after-treatment machine, to the end of the continuous form, can be achieved.

According to the first aspect of the present invention, there is provided a conveyance apparatus for a continuous form having sprocket holes on both sides thereof provided in a high-speed printing system comprised of a printing machine including a printing means and an after-treatment machine including a cutter of the continuous form and a stacker table, comprising: a constant-speed conveyance means for feeding the continuous form to the printing means with a constant speed; a pair of ejection rollers located downstream of the constant-speed conveyance means for conveying and ejecting the continuous form under tension by moving the form a little faster than the peripheral speed of the constant-speed conveyance means; a pair of drawing rollers provided at an entrance of the after-treatment machine for pulling the continuous form therein ejected from the printing machine without delay; a end detecting means for outputting an end signal when the continuous form disengages from the last sprocket hole; and a control means for decreasing the peripheral speed of the pair of ejection rollers until it becomes lower than that of the constant-speed conveyance means, when the end signal is received from the end detecting means.

When the driving means for the pair of ejection rollers is an induction motor having a characteristic that the rotational speed thereof is decreased when the load thereof is increased, the control means decreases the rotational speed of the pair of ejection rollers by reducing the alternating current supplied to the induction motor.

Further, when the driving means for the pair of ejection rollers is an induction motor of the type having a characteristic that the rotational speed thereof is decreased when the load thereof is increased, the control means decreases the rotational speed of the pair of ejection rollers by increasing the secondary resistance value of the induction motor.

According to the second aspect of the present invention, there is provided the same structure as explained in the first aspect of the present invention except for function of the control means. The control means in the second aspect stops the power supply to a driving means of the pair of ejection rollers when the end signal is received from the end detecting means and a predetermined time, which is shorter than the time that the end of the continuous form moves from the constant-speed conveyance roller to the ejection rollers, has passed.

The the control means may gradually decrease the power supply to the driving means of the pair of ejection rollers during the time before the power supply thereto is completely stopped.

Further, according to the third aspect of the present invention, there is provided the same structure as explained in the first aspect of the present invention except for function of the control means. The control means in the third aspect increases the rotational speed of the pair of drawing rollers until it becomes equivalent to that of the pair of ejection rollers with no load, when the end signal is received from the end detecting means.

The control means may not only decrease the rotational speed of the pair of ejection rollers but also increases the rotational speed of the pair of drawing rollers until the rotational speed of the drawing rollers become a little faster than that of the ejection rollers to give tension to the continuous form.

As a result, the invention realizes a conveyance apparatus for a continuous form printed by a printing machine, by which a normal conveyance condition of the continuous form is continuously been maintained even after the end of the continuous form is released from the pin roller, whereby a stable after-treatment of the continuous form by the after-treatment machine, to the end of the continuous form, can be achieved.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENT

A preferred embodiment according to the present invention will be explained hereinafter with reference to the attached drawings.

Figure 3:
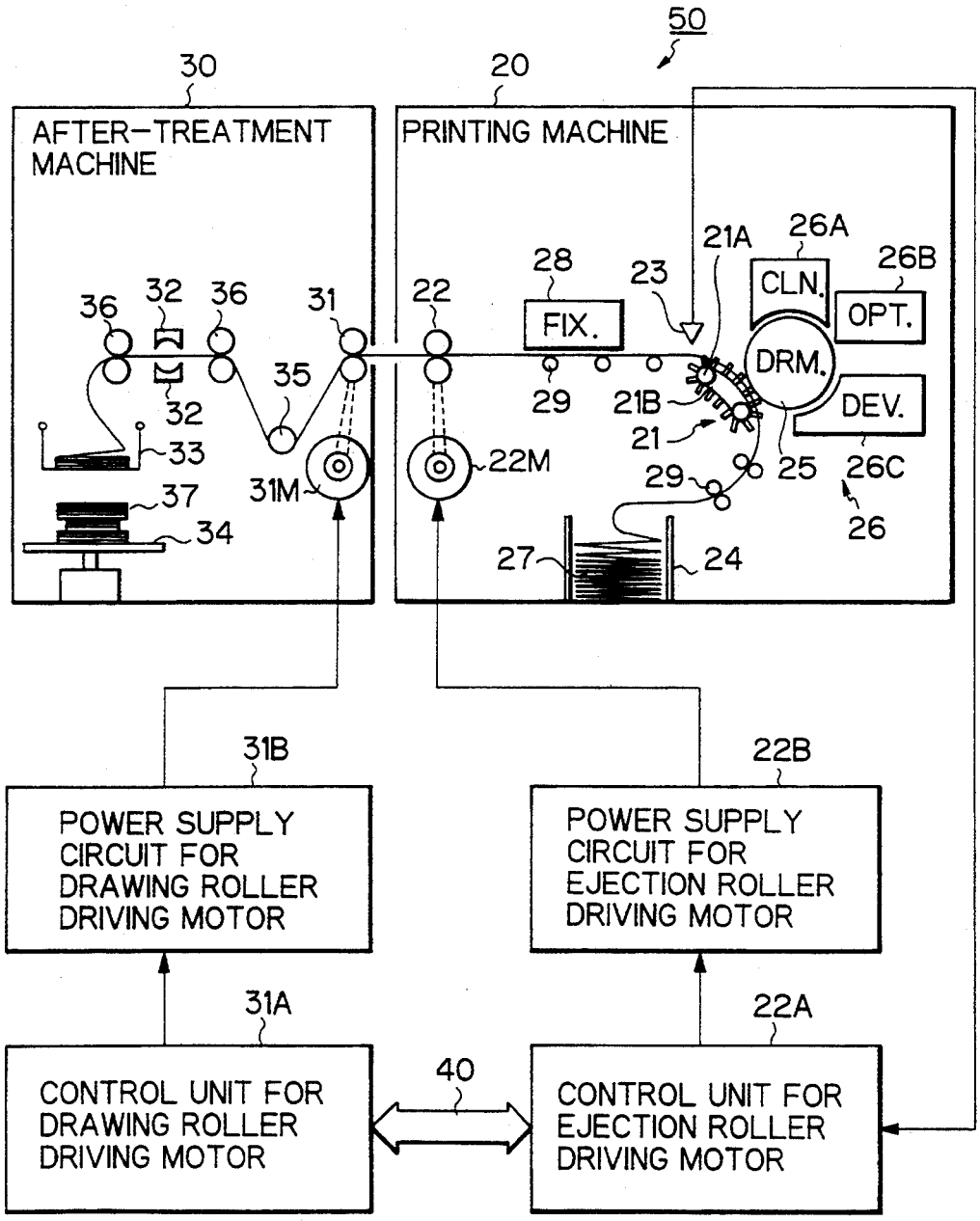
FIG. 3 is a block diagram showing a fundamental construction of the conveyance apparatus for a continuous form printed by a printing machine according to the present invention.

FIG. 3 is a block diagram showing the basic construction of the printing system 50 having a conveyance apparatus for a continuous form printed by a printing machine 20 in the printing system 50 according to the present invention. The printing system 50 includes a high-speed printing machine 20 for printing on the continuous form 27, and an after-treatment machine 30 for after-treating the printed continuous form 27 such as cutting thereof or separation thereof in accordance with the type of the printing.

The printing machine 20 in this embodiment uses electrophotography technology, so that it includes a laser beam printer comprised of a photoreceptor drum (DRM. in FIG. 3) 25, a printing unit 26 having a cleaning portion (CLN. in FIG. 3) 26A, an optical portion (OPT. in FIG. 3) 26B, and a development portion (DEV. in FIG. 3) 26C, and a fixing unit (FIX in FIG. 3.) 28. The continuous form 27 before printing is folded regularly at a perforation provided thereon and is stored in a continuous form stocker 24.

Note, the printing machine 20 is not limited to a laser printer, it can be, for example, an LED printer, a dot impact printer, a line printer, a thermal sublimation printer, an ink-jet printer, bubble-jet printer, and so on.

Figure 1:
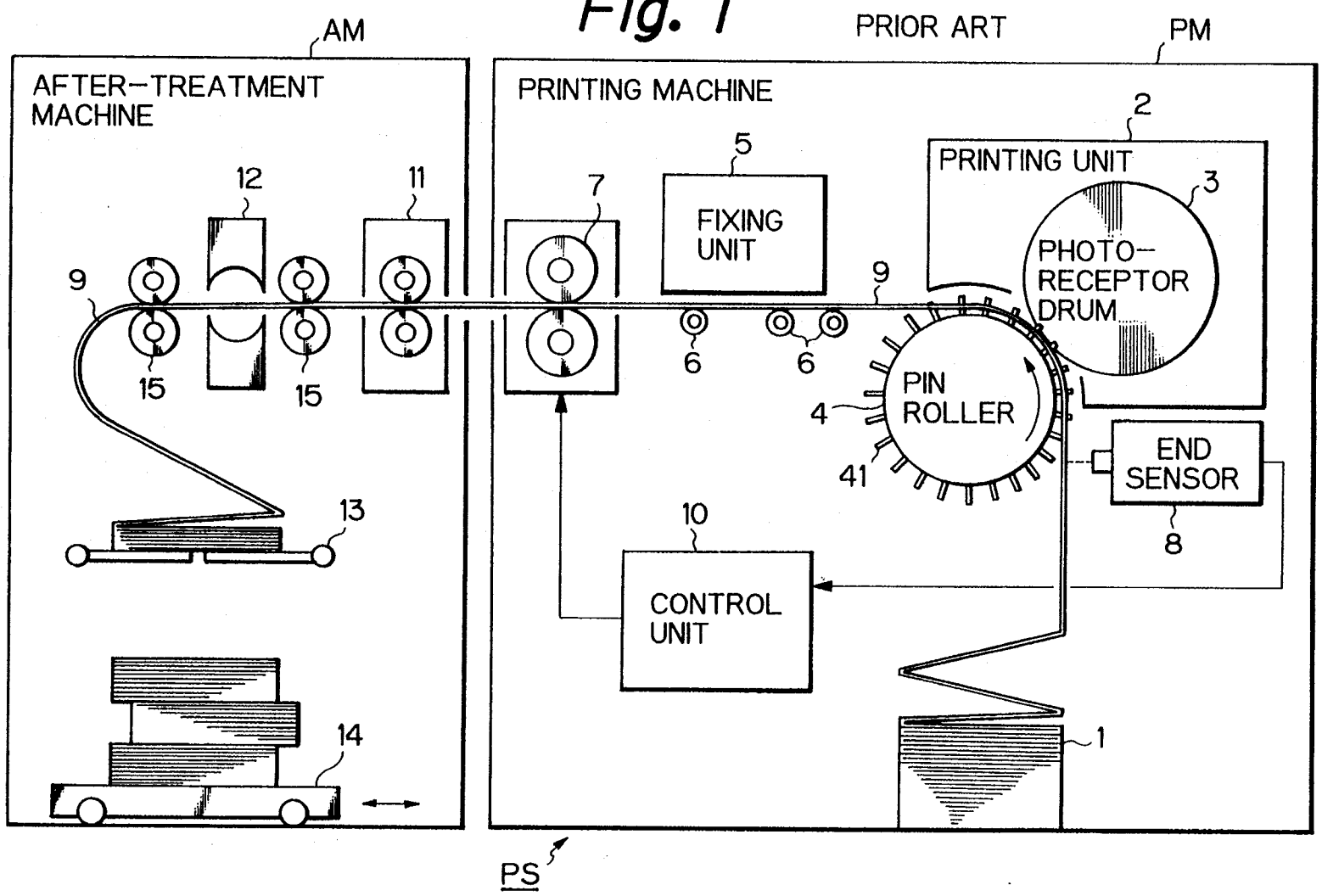
FIG. 1 is a block diagram of one example of a conventional conveyance apparatus for a continuous form printed by a printing machine.
Figure 2:
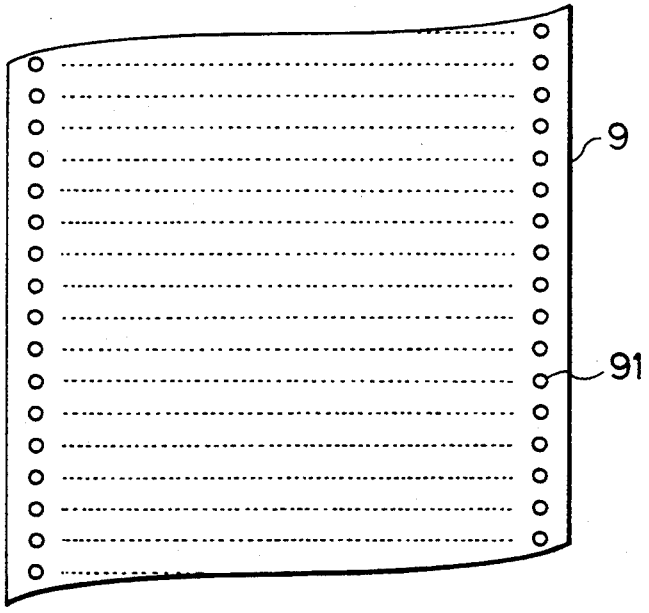
FIG. 2 is a partial plan view of the continuous form used in the printing system having a conveyance apparatus therein.

The conveyance apparatus in the printing machine 20 includes a tractor 21 having two rollers 21A and a belt 21B on which pins are planted on both edges thereof at a predetermined interval, a pair of ejection rollers 22, and a plurality of guide rollers 29. The tractor 21 moves mechanically synchronous with the rotation of the photoreceptor drum 25, and conveys the continuous form 27 having sprocket holes on both edges thereof as explained in FIG. 2, at a constant speed, in contact with the photoreceptor drum 25. The ejection rollers 22 are driven by an ejection-roller-driving motor 22M. The ejection-roller-driving motor 22M is controlled by a power-supply circuit for ejection-roller-driving motor 22B in accordance with an output signal from a control unit for ejection-roller-driving motor 22A.

Further, there is provided an end sensor 23 near the tractor 21 for detecting the end of the continuous form 27. When the end sensor detects the end of the continuous form 27, an end signal is output by the end sensor 23. The end signal is input to the control unit for the ejection-roller-driving unit 22A. The end sensor 23 detects the end of the continuous form 27, for example, by the disengagement of the last sprocket hole of the continuous form 27 and the pin on the tractor 21.

Note, though the end sensor 23 is provided at the down stream side of the tractor 21 in FIG. 3, it can be provided at the upstream side of the tractor 21. When the end sensor 23 is provided at the upstream side of the tractor 21, the control unit for ejection-roller-driving motor 22A may calculate the time when the continuous form 27 will be released from the tractor 21 in accordance with the conveyance speed thereof.

The after-treatment machine 30 in this embodiment includes a pair of cutters 32, a stack table 33, a turn table 34, a guide roller 35, and two pairs of tension rollers 36. The conveyance apparatus in the after-treatment machine 30 has a pair of drawing rollers 31 which are controlled by a power-supply circuit for the drawing-roller-driving motor 31B in accordance with an output signal from a control unit for the drawing-roller-driving motor 31A. The control unit for drawing-roller-driving motor 31A is linked to the the control unit for the ejection-roller-driving unit 22A by the communication cable 40 to transmit or receive control data for the ejection-roller-driving motor 22M and the drawing-roller-driving motor 31M.

In the printing machine 20, the stored continuous form 27 in the stocker 24 is pulled by the tractor 21 and is in contact with the printing unit 26 for printing, and then the continuous form 27 is pulled by the ejection rollers 22 and is fed to the after-treatment machine 30. At the printing unit 26, the rotating photoreceptor drum 25 is electrically charged and a latent image is formed on the photoreceptor drum 25 by a laser beam transmitted from the optical portion 26B. This latent image is developed by toner at the development portion 26C and a toner image is formed on the photoreceptor drum 25. Then the toner image on the photoreceptor drum 25 is transferred onto the continuous form 27 fed to the photoreceptor drum 25 at the same speed as the rotational speed thereof. The toner image on the continuous form 27 is fixed at the fixing unit 28 provided downstream of the printing unit 26. In this way, high-speed printing on the continuous form 27 is realized.

The printed continuous form 27 is then conveyed by the ejection rollers 22. The ejection rollers 22 pinch the continuous form 27 and rotate a little faster than the rotational speed of the tractor 21 to give tension on the continuous form 27 between the printing unit 26 and the ejection roller 22 where the fixing unit 28 is located. Actually, the ejection rollers 22 have a faster peripheral speed than the conveyance speed of the continuous form 27 by the tractor 21 when the ejection rollers are free, though the peripheral speed of the ejection rollers 22 is reduced to the constant rotational speed of the tractor 21.

In the after-treatment machined 30, the continuous form 27 is pulled by the drawing rollers 31 and conveyed by the tension rollers 36. The continuous form 27 is then folded at the perforation provided thereon and is stacked on the stack table 33. The pair of cutters 32 located between the two pairs of tension rollers 36 cut the continuous form 27 synchronously with the printing speed thereof at the photoreceptor drum 25 at the change of the substance of the printing. In order to cut the continuous form 27 precisely, the pair of tension rollers 36 provided downstream of the cutter 32 rotate a little faster than the other pair of tension rollers to give tension to the continuous form 27 therebetween. When the continuous form 27 is cut to become a sheaf of papers 37, the stack table 33 discharges the sheaf of papers 37 to the turn table 34. The turn table 34 rotates for a predetermined degrees, such as 90 degrees, at every discharge of the stack table 33 to separate each sheaf of papers 37.

In this way, the continuous form 27 is after-treated in the after-treatment machine 30 at the printing speed of the printing unit 26 in the printing machine 20.

When the end sensor 23 detects the end of the continuous form 27, and the end signal is input to the control unit for the ejection-roller-driving motor 22A, the operation of the ejection rollers 22 or the drawing rollers 31 are changed by the cooperation of the control unit for the ejection-roller-driving motor 22A, the power-supply circuit for the ejection-roller-driving motor 22B, the control unit for the drawing-roller-driving motor 31A, and the power-supply circuit for drawing-roller-driving motor 22B to convey the end of the continuous form 27 smoothly to the stack table 33. The example of the operation of the control units 22A and 31A, and the operation of the power-supply circuits 22B and 31B will be explained hereinafter with reference to the circuit diagram shown in FIG. 4.

Figure 4A:
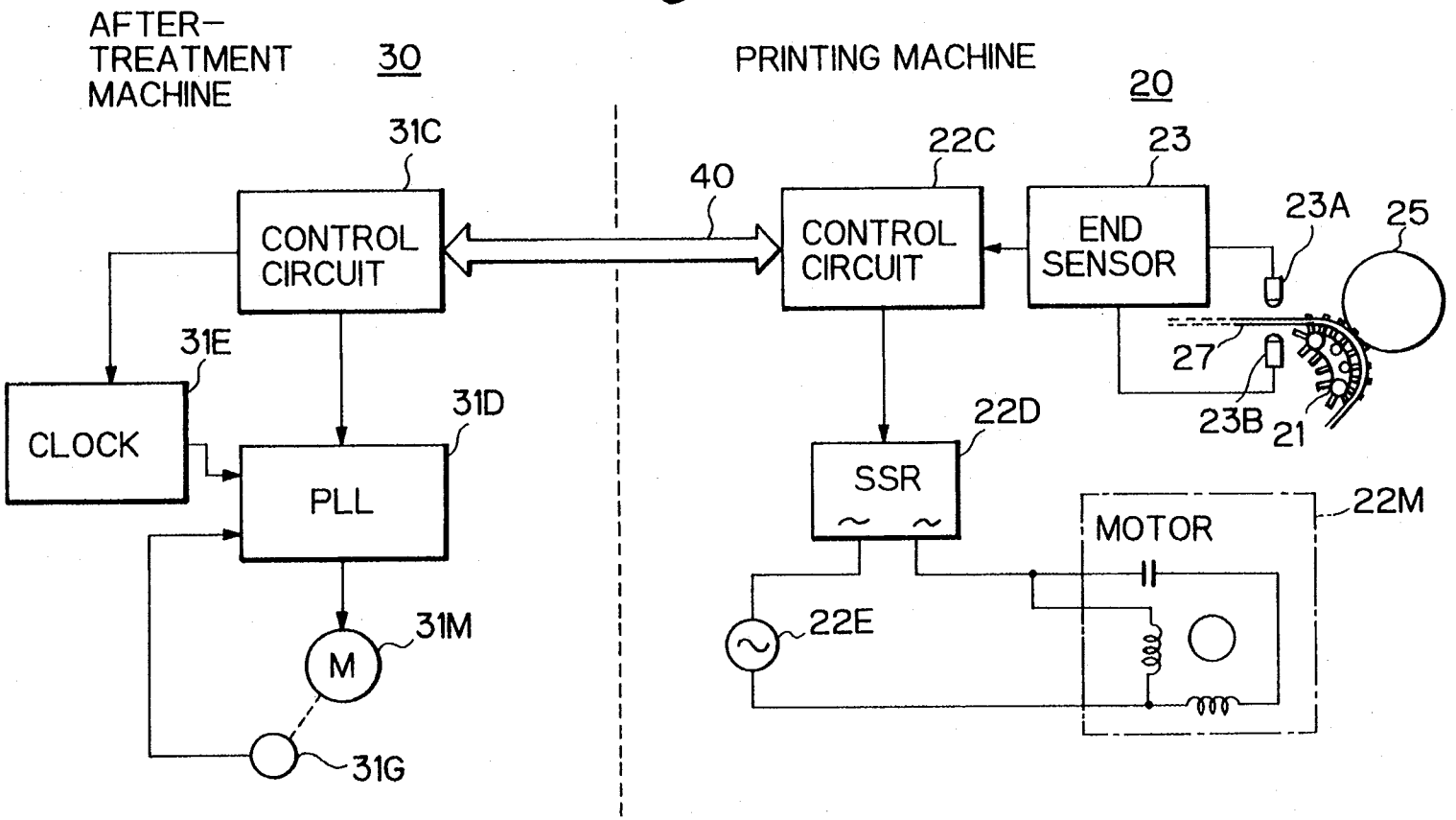
FIG. 4A is a block diagram of the conveyance apparatus for a continuous form printed by a printing machine according to one embodiment of the present invention.

FIG. 4 is a circuit diagram of the control unit for the ejection-roller-driving motor 22A, the power-supply circuit for the ejection-roller-driving motor 22B, the control unit for the drawing-roller-driving motor 31A, and the power-supply circuit for the drawing-roller-driving motor 22B.

In FIG. 4, reference numeral 21 denotes the tractor, 25 denotes the photoreceptor drum, and 23 denotes an end sensor having a light emitting element 23A and light receiving element 23B provided on either side of the continuous form 27. The end sensor 23 is connected to a control circuit 22C including CPU (Central Processing Unit) and peripheral circuit, and the control circuit 22C is connected to a SSR (Solid State Relay) 22D. The SSR 22D is connected to an alternating current (AC) source 22E and the ejection-roller-driving motor 22M.

Note, the end sensor 23 may consist of a photo-interruptor, a supersonic-wave sensor, a power sensor for detecting a change of the power supply to the tractor 21, or a velocity sensor for detecting the change of the conveyance speed of the continuous form 27.

The ejection-roller-driving motor 22M consists as a single-phase induction motor including a capacitor C and two inductances L. In the single-phase induction motor 22M, the voltage phase of one of the inductances L can be shifted by using a capacitor C. Accordingly, the rotational speed of the single-phase induction motor 22M will be decreased in accordance with the phase lag of the rotor thereof when the alternating current from the source 22E is decreased by the SSR 22D by reducing the alternating current supplied by the SSR 22D.

There is, also provided a control circuit 31C including CPU and peripheral circuit which is connected to the control circuit 22C by the communication cable 40. The control circuit 22C and 31C mutually exchange data such as the end signal, occurrence of conveyance trouble (jamming of the continuous form), cutting position of the continuous form 27, or a change of the speed of the tractor 21. The control circuit 31C is connected to a PLL (Phase Lock Loop) control circuit 31D and a clock generator 31E. The control circuit 31C controls the ON/OFF operation of the PLL control circuit 31D and designates a frequency of the reference clock at the PLL control circuit 31D.

The drawing-roller-driving motor 31M is controlled by the PLL control circuit 31D and the clock generator 31E which generates a reference clock for PLL control. An encoder-pulse generator 31G is connected directly to the rotational shaft of the drawing-roller-driving motor 31M and generates a pulse signal in accordance with the rotational speed of the driving motor 31M. The reference clock output from the clock generator 31E and the pulse signal output from the encoder-pulse generator 31G are both input to the PLL control circuit 31D.

The PLL control circuit 31D regulates the power supplied to the drawing motor 31M to make the frequency and the phase of the pulse generated by the encoder-pulse generator 31G equivalent to those of the reference clock generated by the clock generator 31E.

Figure 4B:
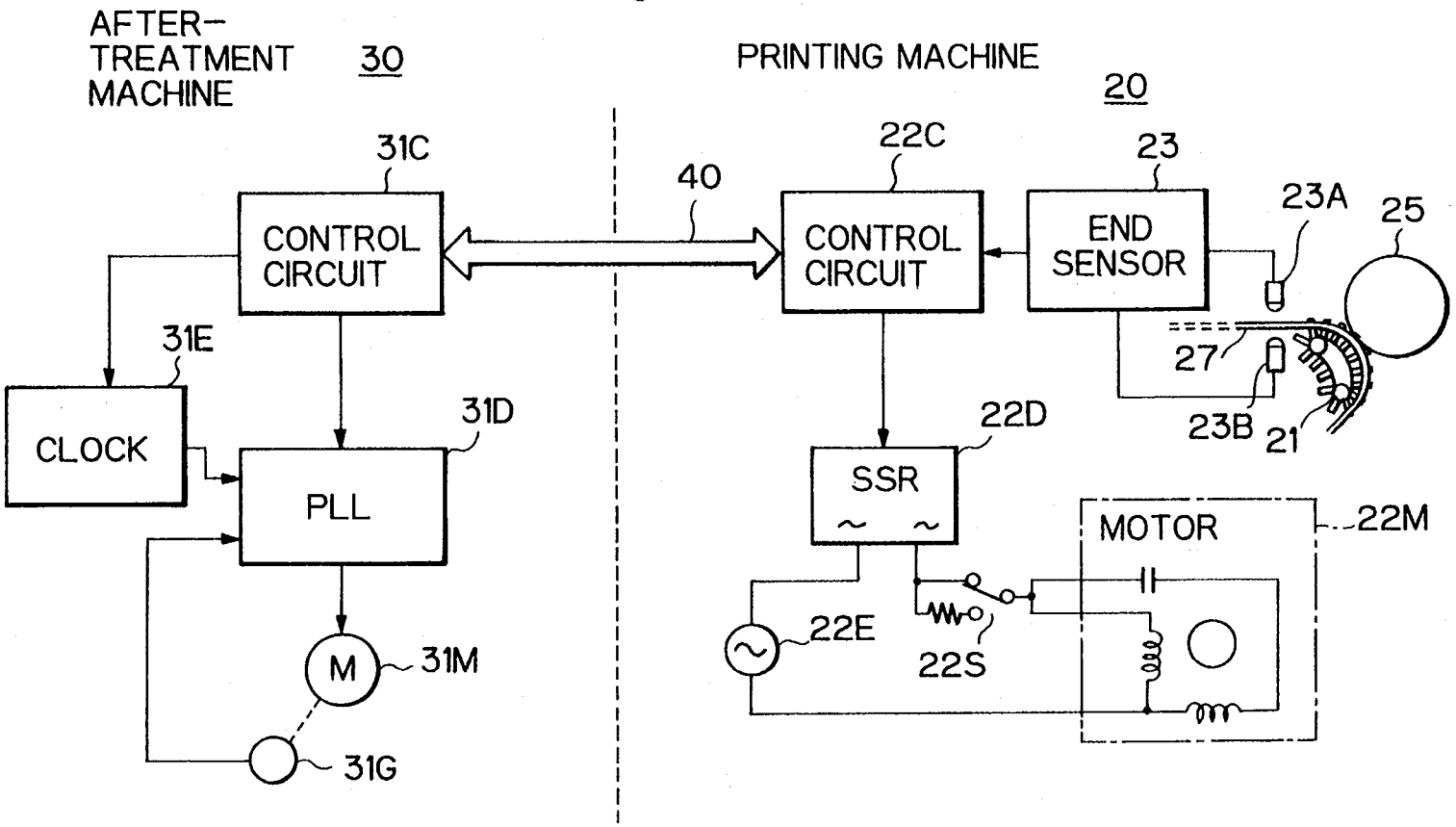
FIG. 4B is a block diagram of the conveyance apparatus for a continuous form printed by a printing machine according to the modified embodiment as shown in FIG. 4A.

Note, if the ejection-roller-driving motor 22M consists of an induction motor, the rotational speed thereof will be decreased by reducing the alternating current. However, if the ejection-roller-driving motor 22M consists of an induction motor of the winding type, the rotational speed thereof can be decreased by increasing a resistance value by switching a switch 22S as shown in FIG. 4B.

FIGS. 5A to 5D are timing charts showing operations of the end sensor 23, the SSR 22D, a peripheral speed of the ejection rollers 22 driven by the motor 22M, and a peripheral speed of the drawing rollers 31 according to the first operational embodiment of the present invention shown in FIGS. 3 and 4.

Figure 5A:
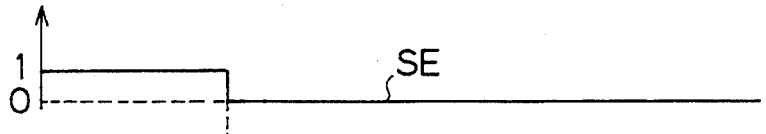
FIGS. 5A, 5B, 5C and 5D are timing charts showing operations of an end sensor, a solid state relay, the peripheral speed of a pair of ejection rollers and a peripheral speed of a pair of drawing rollers according to the first embodiment of the present invention.
Figure 5B:
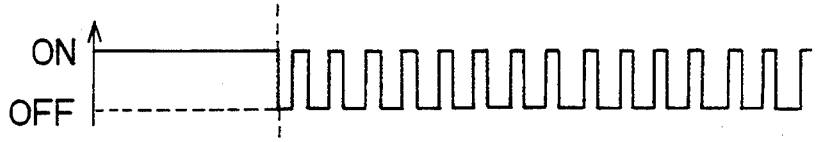

When the end sensor 23 detects the end of the continuous form 27 at time t1 as shown in FIG. 5A, the low level end signal SE is transmitted from the sensor 23 to the control circuit 22C. The control circuit 22C applys a constant voltage to the SSR 22D before time t1, but applies a pulsed voltage to the SSR 22D after the time t1. Then the SSR 22D changes from ON state to a periodical ON and OFF state as shown in FIG. 5B. As a result, the alternating current from the AC source 22E is reduced and the rotational speed of the ejection-roller-driving motor 22M is decreased. When the rotational speed of the driving motor 22M is decreased, the peripheral speed VE of the ejection rollers 22 is decreased to less than than the conveyance speed VC of the continuous form 27 as shown in FIG. 5C.

Figure 5C:
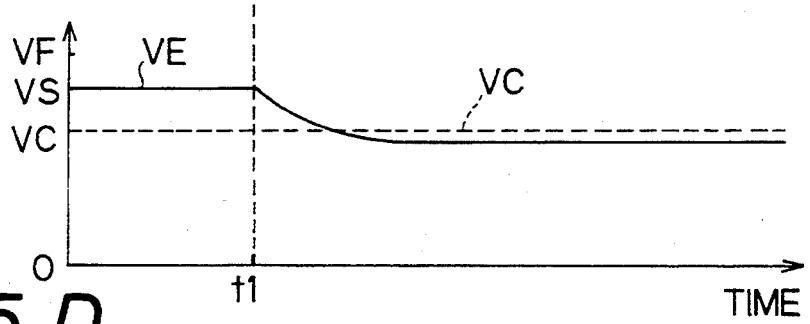

The ejection rollers 22 rotate at the peripheral speed VS which is faster than the conveyance speed VC before time t1 as shown in FIG. 5C. The free peripheral speed VF of the ejection rollers 22 with no load is originally faster than the peripheral speed VC of the tractor 21, and when the continuous form 27 is engaged with the tractor 21, the peripheral speed of the ejection rollers 22 is reduced to VS (<VF) which is still faster than the peripheral speed VC of the tractor 21 since the ejection rollers slip on the surface of the continuous form 27.

Figure 5D:
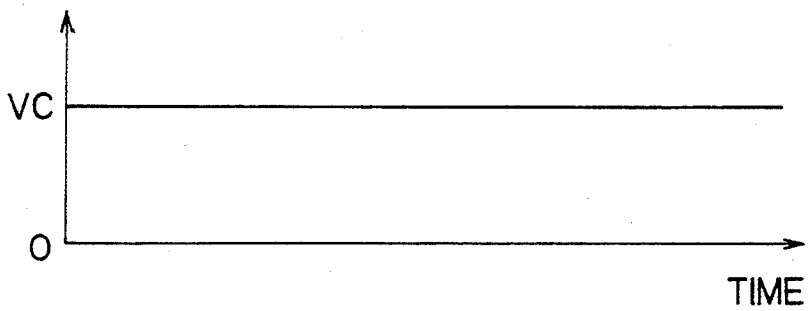

The peripheral speed VC of the drawing rollers 31 is not changed before and after the time t1 as shown in FIG. 5D. Accordingly, when the peripheral speed of the ejection rollers 22 becomes lower than the conveyance speed VC after time t1, tension is applied to the continuous form 27 between the ejection rollers 22 and the drawing rollers 31, thereby the continuous form 27 is normally pulled through the after-treatment machine 30 without jamming.

Figure 6A:
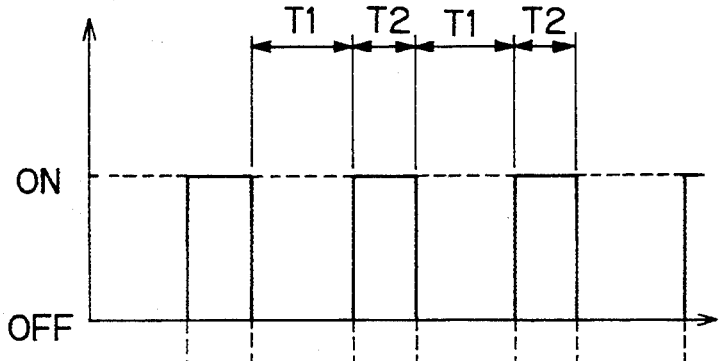
FIG. 6A is an enlarged timing chart showing an operation of the solid state relay shown in FIG. 5B.
Figure 6B:
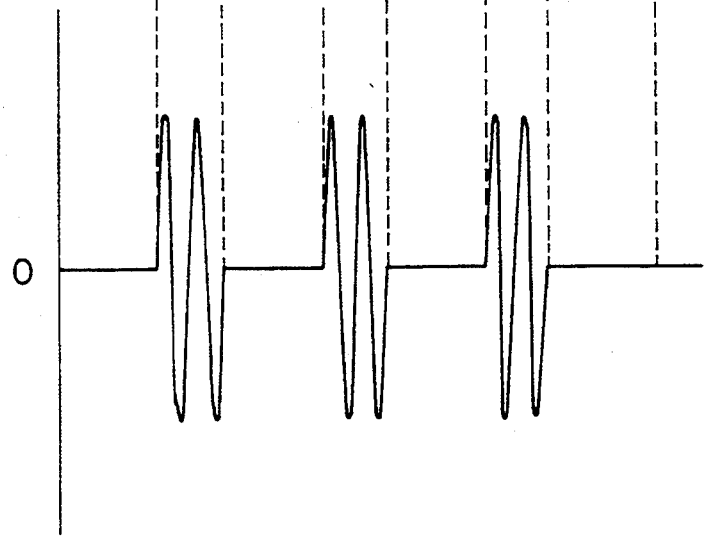
FIG. 6B is a waveform of a current applied to a driving motor for the pair of ejection rollers as shown in FIG. 4.

FIG. 6A is an enlarged timing chart showing the operation of the SSR 22D in FIG. 5B, and FIG. 6B is a waveform of the alternating current applied from the AC source 22E to the ejection-roller-driving motor 22M as shown in FIG. 4. In the first embodiment, the SSR 22D switches between the ON and OFF states at a frequency of approximately 9 Hz to prevent fluctuation. This frequency of 9 Hz is selected not to be a factor of the commercial power frequencies of 50 Hz nor 60 Hz, and the time period of OFF state T1 and of the ON state T2 are 70 ms and 40 ms respectively. The duty ratio is 37.5% in this case.

Concretely, the constant conveyance speed of the continuous form 27, which is equivalent to the peripheral speed of the tractor 21 is 751 mm/s in this embodiment. The peripheral speed of 792 mm/s of the ejection rollers 22 when the continuous form 27 is engaged, will be decreased to 732 mm/s after the disengagement of the continuous form with the tractor 21. Further, the peripheral speed of the drawing rollers 31 is 751 mm/s which is equivalent to the peripheral speed of the tractor 21. Accordingly, the difference of peripheral speeds between the ejection rollers (=732 mm/s) and the drawing rollers (=751 mm/s) will give the continuous form 27 a tension between the ejection rollers 22 and the drawing rollers 31, thereby the continuous form 27 is smoothly pulled in the after-treatment machine 30.

FIGS. 7A to 7D are timing charts showing operations of the end sensor 23, the SSR 22D, a peripheral speed of the ejection rollers 22, and a peripheral speed of the drawing rollers 31 according to the second operational embodiment of the present invention shown in FIGS. 3 and 4.

Figure 7A:
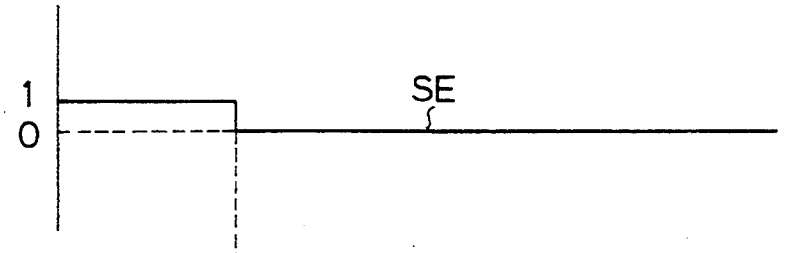
FIGS. 7A, 7B, 7C and 7D are timing charts showing the operation of an end sensor and of a solid state relay, the peripheral speed of a pair of ejection rollers, and the peripheral speed of a pair of drawing rollers according to the second embodiment of the present invention.
Figure 7B:
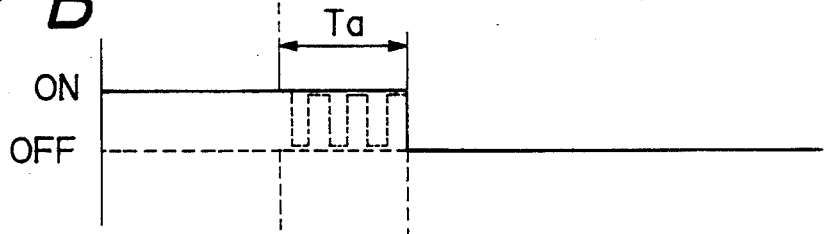

When the end sensor 23 detects the end of the continuous form 27 at time t1 as shown in FIG. 7A, the low-level end signal SE is transmitted from the sensor 23 to the control circuit 22C. The control circuit 22C applys a constant voltage to the SSR 22D before time t1, but when the end signal is input to the control circuit 22C, it stops applying the voltage to the SSR 22D at time t2 with a delay time Ta. Accordingly, the SSR 22D changes from ON state to OFF state at time t2 as shown in FIG. 7B. The delay time Ta must be shorter than the time that the end of the continuous form 27 moves from the tractor 21 to the ejection rollers 22. The delay time Ta is, for example, set to 0.5 s.

Figure 7C:
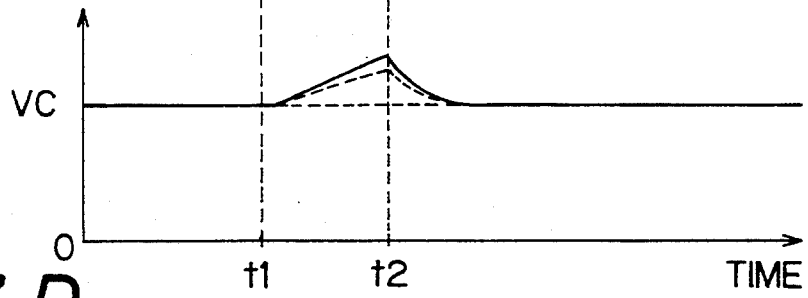

As a result, the peripheral speed of the ejection rollers 22 increases from time t1 to t2 since the continuous form 27 is released from the tractor 21, then the peripheral speed of the ejection rollers 22 gradually decreases after time t2 to become equivalent to the conveyance speed VC of the drawing rollers 31 in the after-treatment machine 30 as shown in FIG. 7C.

Figure 7D:
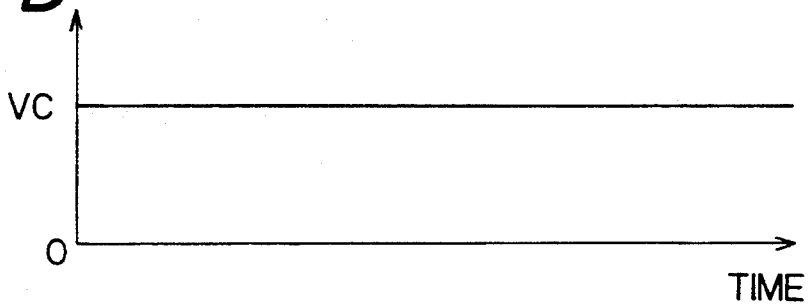

The peripheral speed VC of the drawing rollers 31 is not changed before and after the time t1 as shown in FIG. 7D. Accordingly, when the peripheral speed of the ejection rollers 22 increases after time t1, the continuous form 27 becomes slack between the ejection rollers 22 and the drawing rollers 31. However, the ejection rollers 22 is stopped before the continuous form 27 is excessively slackened between the ejection rollers 22 and the drawing rollers 31 to prevent jamming thereof. When the power supply to the ejection rollers 22 is stopped, the ejection rollers 22 will become a load on the drawing rollers 31. A slight slackening of the continuous form 27 between the ejection rollers 22 and the drawing rollers 31 is necessary to prevent the drawing rollers 31 slipping on the surface of the continuous form 27 due to the sudden increase in the load offered by the ejection rollers 22.

FIGS. 8A to 8D are timing charts showing operations of the end sensor 23, the frequency of the clock generator 31E, the peripheral speed of the drawing rollers 31, and a peripheral speed of the ejection rollers 22 according to the third embodiment of the present invention as shown in FIGS. 3 and 4.

Figures 8A, 8B, 8C, 8D:
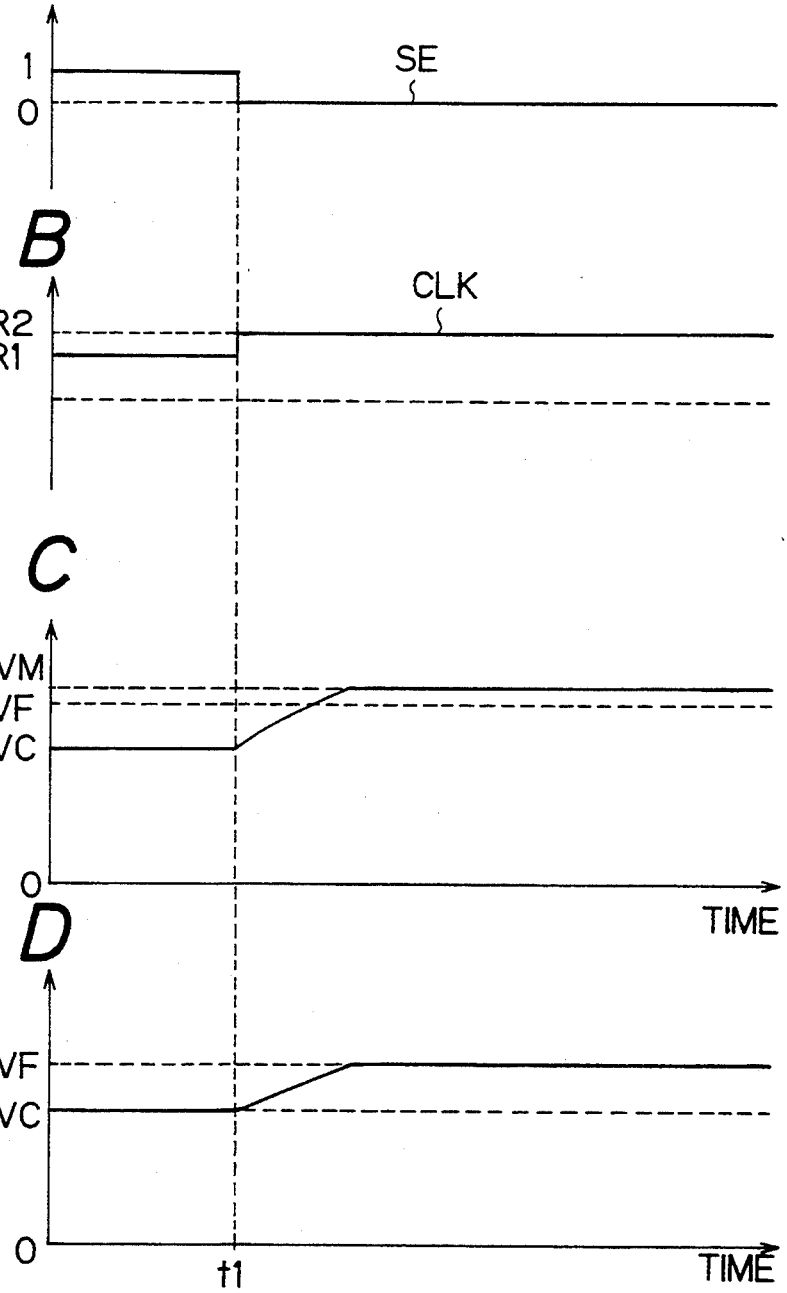
FIGS. 8A, 8B, 8C and 8D are timing charts showing the operation of an end sensor, the frequency of a clock generator, the peripheral speed of a pair of drawing rollers, and the peripheral speed of a pair of ejection rollers according to the third embodiment of the present invention.

When the end sensor 23 detects the end of the continuous form 27 at time t1 as shown in FIG. 8A, the low level end signal SE is transmitted from the sensor 23 to the control circuit 22C. The control circuit 22C transmits the end signal SE to the control circuit 31C via the communication cable 40. Then the control circuit 31C makes the clock generator 31E change the frequency of the reference clock CLK from R1 to R2, which is larger than R1, as shown in FIG. 8B.

As a result, the PLL control circuit 31D increases the rotational speed of the drawing-roller-driving motor 31M in accordance with the increased reference clock CLK. When the rotational speed of the driving motor 31M is increased, the peripheral speed of the drawing rollers 31 is increased to become VM as shown in FIG. 8C.

On the other hand, when the continuous form 27 is released from the tractor 21, the peripheral speed of the ejection rollers 22 is increased to VF which is the speed thereof with no load. Accordingly, the frequency R2 of the increased reference clock CLK is previously defined to make the peripheral speed VM of the drawing rollers 31 higher than the peripheral speed VF of the ejection rollers 22 as shown in FIG. 8C.

Concretely, the peripheral speed of the drawing rollers 31 is increased to 848 mm/s, which is higher than the peripheral speed of the ejection rollers 22, when the continuous form 27 is disengaged from the constant conveyance speed of 751 mm/s in this embodiment.

Figure 9:
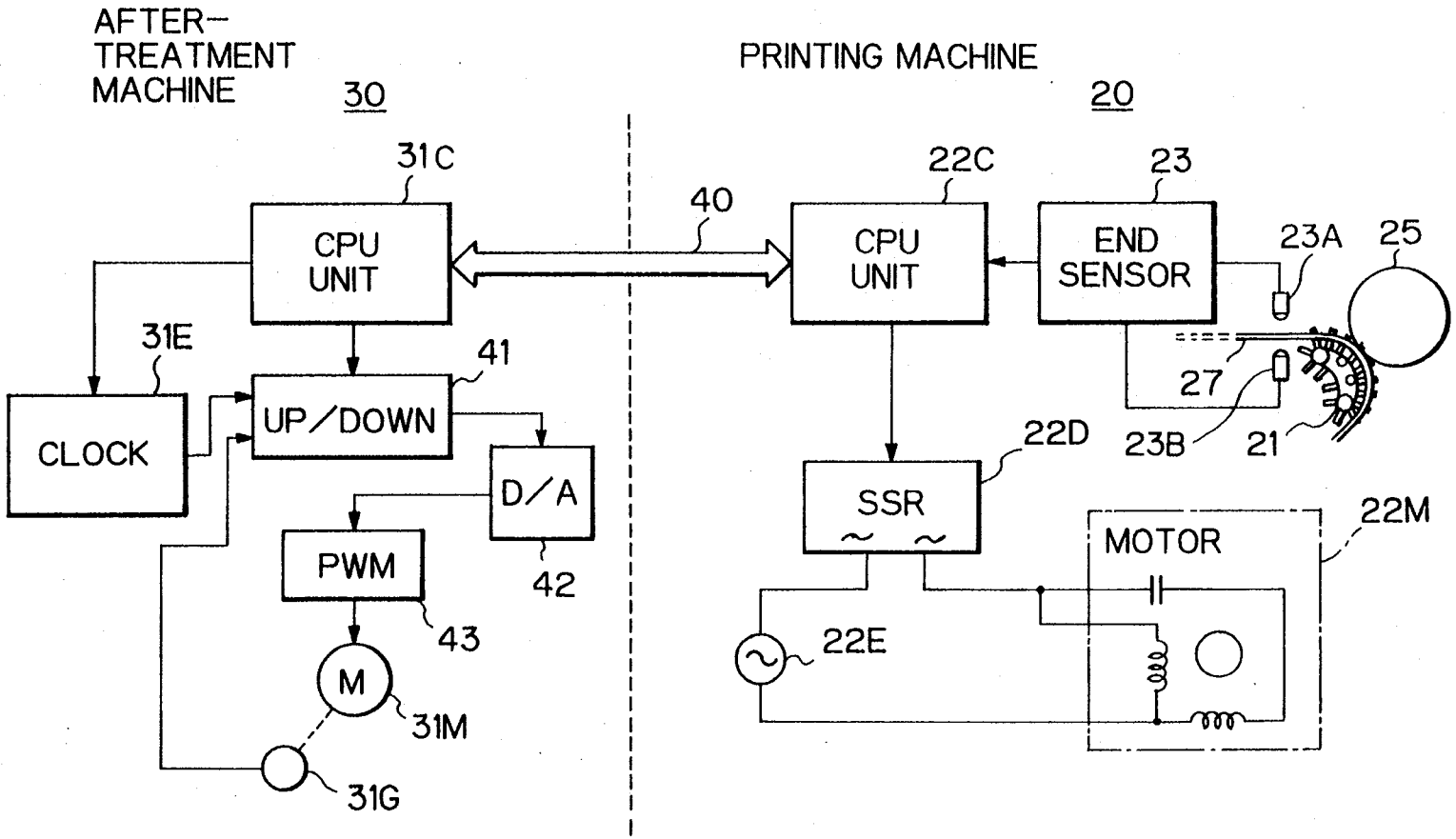
FIG. 9 is a block diagram of the conveyance apparatus for a continuous form printed by a printing machine according to other embodiment of the present invention.

FIG. 9 is an other concrete block diagram showing the construction of the control unit for the ejection-roller-driving motor 22A, the power-supply circuit for the ejection-roller-driving motor 22B, the control unit for the drawing-roller-driving motor 31A, and the power-supply circuit for the drawing-roller-driving motor 31B. In this embodiment, the construction of the the control unit for the ejection-roller-driving motor 22A, the power-supply circuit for the ejection-roller-driving motor 22B is the same as shown in FIG. 4. Accordingly, an explanation will given only for the construction of the control unit for the drawing-roller-driving motor 31A, and the power-supply circuit for drawing-roller-driving motor 31B.

In FIG. 9, a up/down counter 41, a digital to analog (D/A) converter 42, and a pulse width modulation controller 43 are provided instead of PLL control circuit 31D in FIG. 4. The up/down counter 41 is connected to the reference clock generator 31, the encoder-pulse generator 31G and the D/A converter 42, and the pulse width modulation controller 43 is connected to the D/A converter and the driving motor 31M.

In this embodiment, the up/down counter 41 is provided for detecting the frequency difference between the pulse signal output from the encoder-pulse generator 31G and the reference-clock generator 31E. That is, the up/down counter 41 counts the difference of the number of pulses generated at the encoder-pulse generator 31G from the reference-clock, and outputs the difference thereof as a digital signal. The output signal from the up/down counter 41 is transmitted to the pulse-width-modulation controller 43 after being converted from a digital signal to an analog signal at the D/A converter 42. The speed of the driving motor 31M is controlled by the output of the pulse-width-modulation controller 43 in accordance with the difference between the output frequency of the encoder-pulse generator 31G and the frequency of the reference-clock generator 31E. In this way, the speed of the driving motor 31M is defined by the frequency of the reference-clock generator 31E, thus the speed of the driving motor 3M can be changed by changing the reference-clock.

The circuit as shown in FIG. 9 can be used for all of the operational embodiments as explained with FIGS. 5A to 5D, 6A to 6B, 7A to 7D, and 8A to 8D.

In above-described three operational embodiments, only the ejection rollers 22 or the drawing rollers 31 are controlled when the continuous form 27 is released from the tractor 21 and end signal is generated. However, the ejection rollers 22 and the drawing rollers 31 can be controlled at the same time by combining the above-described control for them.

For example, the control circuit 22C can gradually decrease the power supply to the ejection-roller-driving motor 22M by reducing the alternating current during the time before the power supply thereto is completely stopped as shown in FIG. 7B and 7C, by the dotted line, or the control circuit 22C can decrease the rotational speed of the ejection rollers 22 and the control circuit 31C can increase the rotational speed of the drawing rollers 31 until the rotational speed of the drawing rollers 31 become a little faster than that of the ejection rollers 22 to provide tension to the continuous form 27.

What is claimed is:

1. A continuous paper conveyance apparatus for a continuous paper, the continuous paper conveyance apparatus being provided for use in a combination of a printing apparatus having a printing means with an after-treatment apparatus, comprising:

means for feeding said continuous paper to said printing means of said printing apparatus at a first feeding speed;

a first pair of rollers positioned downstream of said printing means and rotating at a peripheral second speed which is higher than said first feeding speed of said means for feeding, the continuous paper printed by said printing means being tensioned by said first pair of rollers, said first pair of rollers being arranged to feed the continuous paper at said second feeding speed after a trailing edge of the continuous paper becomes disengaged from said feeding means;

a second pair of rollers positioned at an entrance portion of said after-treatment apparatus for pulling the continuous paper fed by said first pair of rollers into the after-treatment machine;

means for detecting a disengagement of the trailing edge of the continuous paper from said feeding means, said means for detecting including means for outputting an end signal in accordance with detecting of said disengagement; and control means for receiving and responding to said end signal output from said means for detecting, said control means controlling the peripheral speed of said first pair of rollers to rotate said first pair of rollers at a third feeding speed lower than said second feeding speed in response to said end signal.

2. The conveyance apparatus as in claim 2, further comprising driving means for said first pair of rollers, wherein said driving means includes an induction motor having a characteristic that a rotational speed thereof is decreased when a load thereon is increased, and said control means decreases said second peripheral speed of the first pair of rollers by reducing an alternating current applied to said induction motor.

3. The conveyance apparatus as in claim 1, further comprising driving means for said first pair of rollers, wherein said driving means for said first pair of rollers includes an induction motor of the winding type, having a characteristic that a rotational speed thereof is decreased when a load thereon is increased, and said control means decreases said second peripheral speed of said first pair of rollers by increasing a resistance value of said induction motor.

4. Conveyance apparatus for a continuous form provided in a printing system including a printing machine having printing means and an after-treatment machine comprising:

constant-speed conveyance means for feeding the continuous form to the printing means at a constant speed;

a pair of ejection rollers located downstream of said constant-speed conveyance means for conveying and ejecting the continuous form, under tension, said ejection rollers having driving means and a peripheral speed higher than a peripheral speed of said constant-speed conveyance means;

a pair of drawing rollers positioned at an entrance to the after-treatment machine for pulling therein the continuous form injected by the printing machine;

end detecting means for outputting an end signal when a disengagement of the continuous form from said constant-speed conveyance means is detected; and control means for interrupting a power supply to said driving means for the ejection rollers when said end signal is received from said end detecting means, and when a predetermined period of time, which is shorter than a time for the end of the continuous form to move from the constant-speed conveyance means to the ejection rollers, has passed.

5. The conveyance apparatus as set forth in claim 4, wherein the control means gradually decreases the power supplied to the driving means for the ejection rollers during said time before the power supply thereto is completely stopped.

6. Conveyance apparatus for a continuous form provided in a printing system including a printing machine having a printing means and an after-treatment machine comprising:

a constant-speed conveyance means for feeding a continuous form to the printing means with a constant speed;

a pair of ejection rollers located downstream of the constant-speed conveyance means for conveying and ejecting the continuous form, under tension, said ejection rollers having a peripheral speed higher than a peripheral speed of said constant-speed conveyance means;

a pair of drawing rollers positioned at an entrance to the after-treatment machine for pulling therein the continuous form ejected by the printing machine;

end detecting means for outputting an end signal when a disengagement of the continuous form from the constant-speed conveyance means is detected, said peripheral speed of said ejection rollers becoming increased when said disengagement occurs; and control means for increasing a rotational speed of the drawing rollers until said rotational speed of said drawing rollers becomes at least equivalent to said increased speed of the ejection rollers when the end signal is received from the end detecting means.

7. The conveyance apparatus as in claim 6, wherein the control means decreases the rotational speed of the ejection rollers and provides said increase in the rotational speed of the drawing rollers until the rotational speed of the drawing rollers becomes faster than that of the ejection rollers to provide a tension to the continuous form, when the end signal is received from the end detecting means.

8. A conveyance apparatus for a continuous flexible sheet, said conveyance apparatus being provided in a first operating apparatus and in a successive second operating apparatus, comprising:

means for feeding a continuous sheet at a first feeding speed within said first operating apparatus;

a first pair of rollers, located downstream of said means for feeding and rotating at a peripheral second speed higher than said first feeding speed of said means for feeding, the continuous sheet being given a tension by said first pair of rollers, the first pair of rollers feeding the continuous sheet at the second feeding speed after a trailing edge of the continuous sheet becomes disengaged from the feeding means;

a second pair of rollers, positioned at an entrance portion of said second operating apparatus, for pulling the continuous sheet fed by said first pair of rollers into said second operating apparatus;

means for detecting a disengagement of the trailing edge of the continuous sheet from the feeding means, said means for detecting outputting an end signal in accordance with detecting of said disengagement; and control means, for receiving and responding to the end signal output from said means for detecting, said control means controlling the peripheral speed of said first pair of rollers to rotate at a third feeding speed lower than said second feeding speed.

* * * * *